United States Patent [19]

Moransais

[11] Patent Number: 4,951,827

[45] Date of Patent: Aug. 28, 1990

[54] DISPLAY RACK

[76] Inventor: Charles Moransais, L'Ormaie, Perouges, 01800 Meximieux, France

[21] Appl. No.: 293,449

[22] Filed: Jan. 4, 1989

[30] Foreign Application Priority Data

Jan. 5, 1988 [FR] France ..... 88 00224

[51] Int. Cl.[5] ..... A47F 7/00

[52] U.S. Cl. ..... 211/59.1; 211/194; 248/222.3

[58] Field of Search ..... 211/59.1, 189, 194, 211/90; 248/222.2, 222.3, 223.4

[56] References Cited

U.S. PATENT DOCUMENTS 3,929,230 12/1975 Luthi ..... 211/194
4,403,886 9/1983 Haeusler ..... 211/189 X
4,655,352 4/1987 Noyes et al. ..... 211/189 X
4,771,898 9/1988 Howard et al. ..... 211/133 X
4,815,612 3/1989 Leo, Sr. ..... 211/59.1 X
4,819,814 4/1989 Fogelgren ..... 211/194 X

*Primary Examiner*—Blair M. Johnson
*Attorney, Agent, or Firm*—Browdy and Neimark

[57] ABSTRACT

A display rack including two vertical tubular columns, an arch having two ends respectively connected to an upper portion of the two columns, a pedestal connected between bottom portions of the columns and protruding from a plane containing the columns for supporting the display rack, a product presentation headpiece connected between upper portions of the two columns, panels connected between parallel sections of the two columns for linking the two columns together, and hooks adapted to be affixed to the panels for supporting items to be displayed.

15 Claims, 5 Drawing Sheets

DISPLAY RACK

BACKGROUND OF THE INVENTION

1. Field of the Invention

The present invention relates to a display rack, more particularly a display rack intended for the mounting of suspension shanks or hooks to display products in blister or cardboard packs.

2. The Prior Art

Display racks are generally constituted of buckled-sheet panels with holes for the attachment of suspension shanks or hooks to display products for sale. Such display racks are not very aesthetically pleasing, and do not enhance the products hung on them. Besides, these display racks are destined to present products in straight lines, without the possibility of displaying products on both sides of the rack, and they do not allow for successive panels of the display to be set up at an angle. Finally, known display racks are made out of large size elements making their transportation nearly impossible.

SUMMARY OF THE INVENTION

The present invention aims at remedying these inconveniences by providing a rack having excellent aesthetic qualities, of reduced weight, capable of rapid disassembly, and capable of being associated with other similar display racks in order to obtain a plurality of shapes and to allow for the possibility of attaching support elements of the product for sale on both sides of the display rack.

To that effect, the display rack of the present invention is comprised of two vertical tubular columns joined together atop by an arch and in their bottom part by a pedestal standing out on both sides of the plane in which the two columns stand. These two columns are linked to each other, in the section where they are parallel, with panels used to affix shanks or hooks to support the items to display, and their upper portions are used to hold a product presentation headpiece.

Each column is advantageously made of several sections of tubes placed in the continuation of each other, and is made of two semicircular shells equipped with complementary fasteners placed in opposite fashion along at least one of their edges. Each end of a half shell has, perpendicular to its axle, an inwardly oriented return, destined to be inserted in the circular groove of a cylindrical assembly part positioned between two sections of tube. Each assembly part has two axially shifted circular groves used for axial blockage, but enabling rotation of the extremity of the tube section.

Thus, the skeleton of the display rack can be obtained with tubes made of molded synthetic materials like polystyrene.

Fasteners to attach the two half shells constituting a section of tube are provided by hooks protruding out the edge of one half shell and by corresponding openings made in the edge of the other half shell.

The half shells fasteners are preferably located on a groove used, on an assembled display rack, to house a glued cover strip. The glued cover functions as a decorative cover, possibly having different colors than the columns The cover also serves to protect the fasteners from public access.

In compliance with another characteristic of the invention, each assembly part between two column sections has at least one orifice for the mounting of an attachment key to another adjacent assembly part, making it possible to link several display racks. Two adjacent racks may be linked at an angle with respect to one another because of the pivoting capability of the column sections inside of their associated assembly parts.

Several display racks can, therefore, be assembled to insure an optimum presentation of the product, according to a given site. The display racks can be in line, form one or several angles, or be laid out in zigzags.

Advantageously, each half-shell, which together constitute a section of a vertical column, is molded with a panel having the necessary holes for the attachment of the shanks, hooks or shelves. In practice, when two half-shells are assembled together to form a section of column, their two associated panels are disposed in a jointed fashion and can be attached together with clips going through their corresponding holes, or with dog points molded with one panel entering especially designed orifices in the other panel.

Insofar as the width of the display rack is approximately twice the width of a panel associated with a half shell, the vertical edge of each panel opposite to the edge with the half shell has an outward grove, instrumental in the assembly of the two pairs of panels situated at a determined level of the display rack. The assembly is realized with a synthetic material rail whose section corresponds to two "C"s placed back to back.

This technique is particularly interesting since the elements which constitute the columns and the elements which constitute the display are obtained by molding, with the same molds, yet provide excellent rigidity of the display because of the assembly rail which can be extended to cover the height of several panels.

Preferably, each panel has a series of holes near its connecting edge with a half shell used to clip-fasten a cover strip equipped with clips destined to be inserted in those holes.

Consistent with another characteristic of the invention, the pedestal or base of the display rack is constituted by four identical molded elements, in synthetic material, each of which has a wall extending from one column of the display to the median plane intersecting with the display, where it is prolonged by a second wall extending along that plane to a hook attachment panel. Each element has a perforated hasp to bolt the corresponding element on the other side of the panel while the second wall has holes to allow for the passage of bolts between that element and the element situated on the same side of the display.

The pedestal provides perfect stability to the display rack, and with the addition of a tablet embedded on the top edges of the elements on each side of the rack, it enhances the display's aesthetic qualities.

According to a variation in the realization of this display rack, the two back to back panels comprise regularly distributed funnels, protruding out of each panel, and destined to be forcefully encased one into the other. Each panel provides a horizontally oriented rectangular opening on the panel from which it is protruding.

Advantageously, the fixing element of the items suspension shanks or hooks is constituted of a peg having a rectangular tip at one end that fits the openings in the panel, and that can be inserted in these openings. The peg has a middle portion the length of which is equal to the panel thickness, the cross-section of which is substantially square, and the length of its sides corresponding to the width of the peg. Two opposite edges of this middle part are rounded so that their spacing is equal to the sides of the square cross-section. This peg is mounted on its associated element so that when attached to the panel, the length of the top of the peg is vertically oriented.

It is thus possible to insert a fixing peg into an opening in the panel, and then lock it by pivoting it ninety degrees. This swiveling is enabled in one direction by the rounded surfaces on the middle part.

Preferably, the peg is equipped at its opposite end with a small perpendicular plate, destined to be inserted in a gusset on the item suspension shank or hook. This characteristic simplifies the realization of the various pieces, and allows the use of the pegs to affix different accessories to the panel, such as shelves that can be held by a few pegs. It is therefore possible, in a first step to affix the pegs to the panel, and then mount the accessory, such as a shelf, on the fixation pegs.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

At any rate, the invention will be well understood with the following explanations, in reference to the diagrammatic drawings included, representing, as a non-limitative example, a form of execution of the display rack, in which.

DETAILED DESCRIPTION OF THE PREFERRED EMBODIMENT

Figure 1:
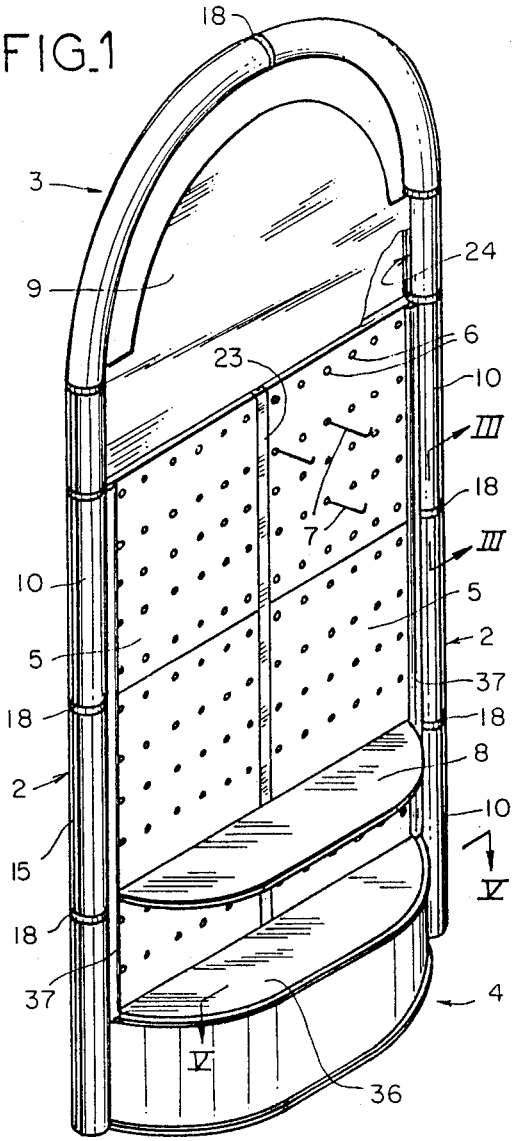
FIG. 1 is a view in perspective of the present invention.

The display represented in the drawings comprises two vertical tubular columns 2 linked at the top y an arch 3 and at the bottom by a pedestal 4. The two columns 2 also serve to mount panels 5 with holes 6 for the attachment of shanks 7 and/or shelves 8. The columns are equipped to receive a headpiece in an upper portion thereof for product presentation.

Each column 2 is constituted, in the embodiment shown in the drawings, by four sections of superposed tubes, with the length of the upper section being approximately half of the length of the other sections. As is more specifically shown in FIG. 2, each section of the column 2 is constituted by two semicircular half shells 10, molded with a panel 5. The corresponding half shells 10 are equipped along their connecting edges with complementing fasteners consisting of hooks 12 on one shell and corresponding holes 13 in the other shell, allowing for clip-fastened assembly. The hooks 12 and the holes 13 are made at the bottom of a groove 14 over which a cover strip 15 is to be glued that will ensure the protection of the hooks against non-desirable external intervention. As it is shown in the drawing, the two panels 5 associated with two complementary half shells 10 are propped against one another, and can be linked with clips or with dog points and cavities provided when the panels are molded.

Figure 3:
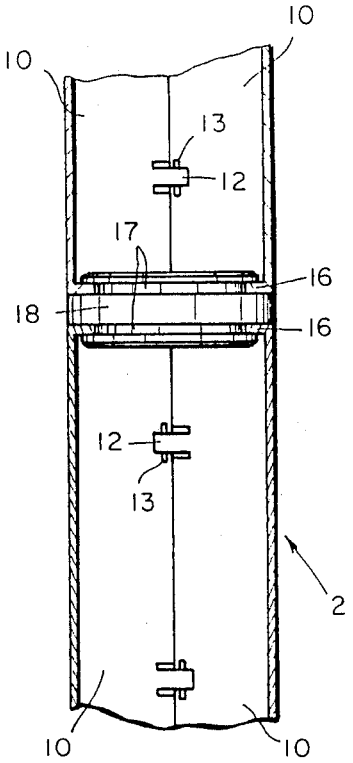
FIG. 3 is a longitudinal cutaway view of a detail of the assembly between two superposed sections according to line III—III of FIG. 1.
Figure 6:
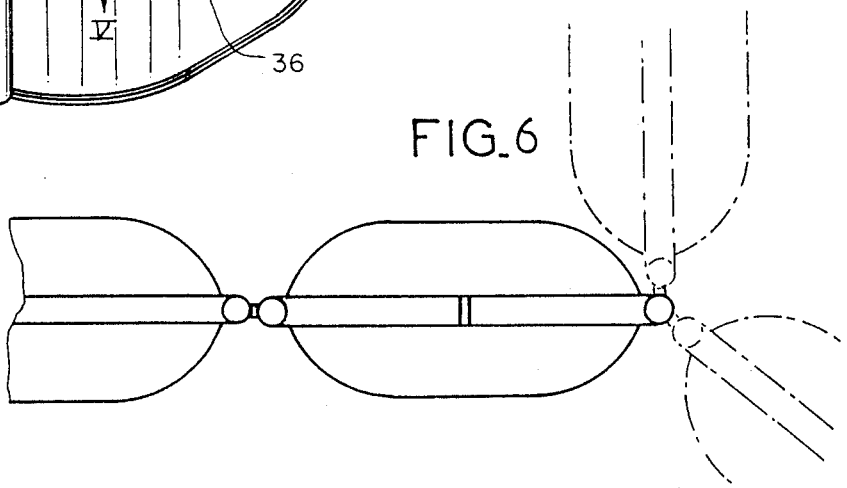
FIG. 6 is a diagrammatic view representing different types of display assemblies.
Figure 2:
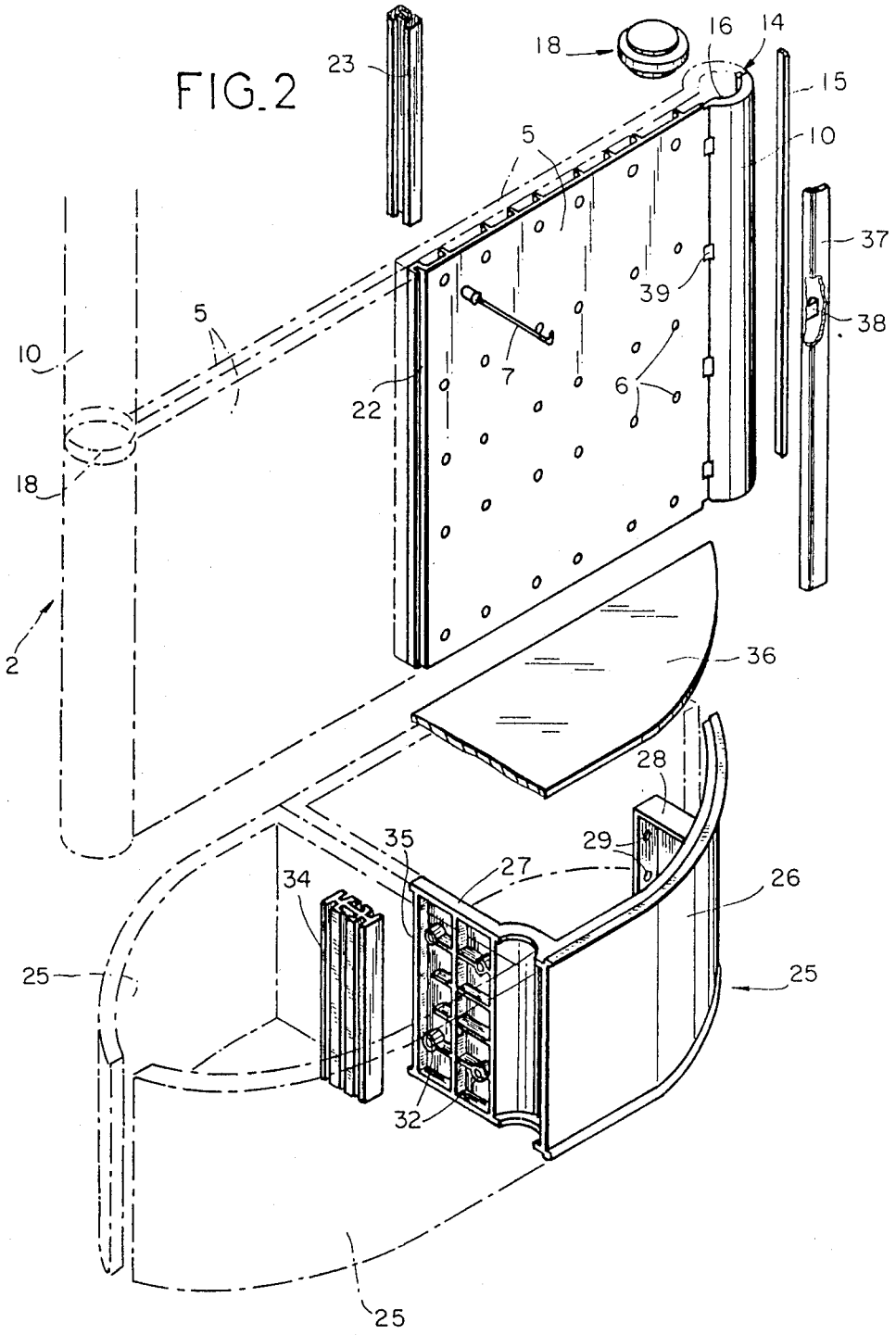
FIG. 2 is an exploded view in perspective of several elements of the display.

As is shown in FIGS. 2 and 3, each half shell 10 is equipped at its two ends with an outwardly oriented return or flange 16 which is to be engaged with the circular groove 17 of a cylindrical assembly part 18 disposed between two sections of superposed tubes. To that effect, an assembly part 18 has two axially shifted groves 17, allowing for the insertion of the two flanges of the two column sections. It must be noted that the half shells 10 can turn in the grooves 17.

Figure 4:
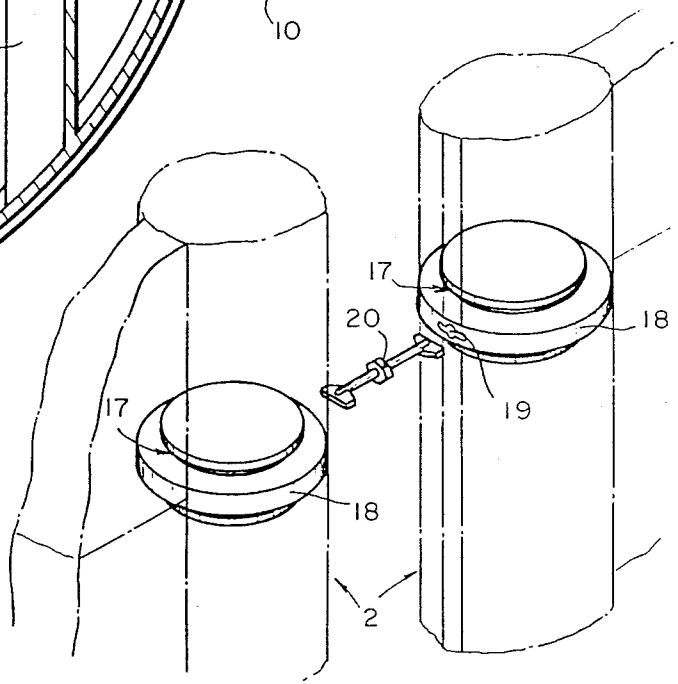
FIG. 4 is a perspective view of two column sections assembly parts.

As is shown in FIG. 4, each assembly part 18 has at least one orifice 19. An assembly key 20, is provided having two extremities on the ends thereof. Each extremity is formed so as to fit to be inserted in an assembly part 18. It is thereby possible to join together two assembly parts 18, and create angles between these two displays by rotating the half shell 10 about the respective assembly parts 18.

Figure 5:
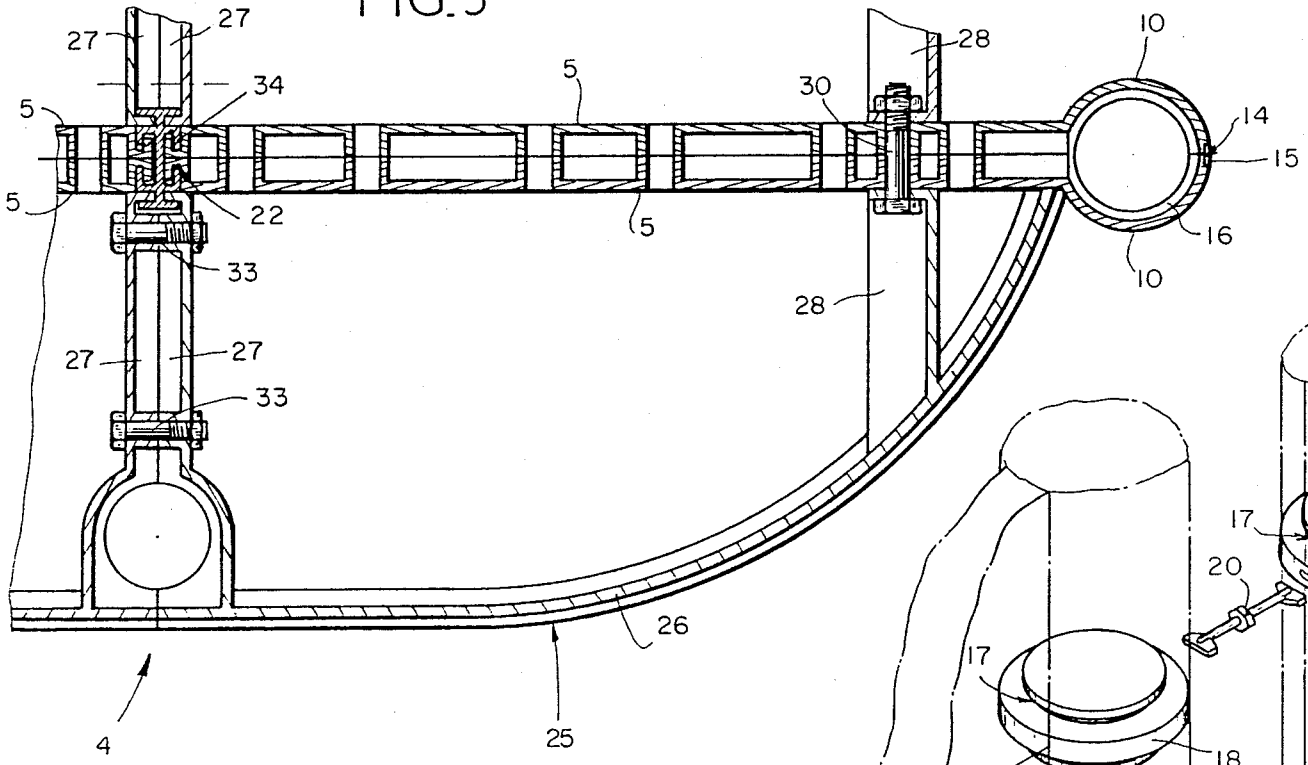
FIG. 5 is a cutaway view through an horizontal plane of a part of the scale, as per line V—V of FIG. 1.

In the embodiment represented by the drawings, the display rack width is twice the width of a panel 5. In order to join together the adjacent parts of the panels situated at the same level, each panel has, at the level of its vertical edge opposite to the edge associated with a half shell, a groove 22 outwardly oriented, the assembly of the two pairs of panels being realized with a rail 23 made of synthetic material, whose section corresponds to the "C" shaped elements placed back to back, or in other words, two "C" shaped pieces their open portions being connected together by a cross-bar see FIG. 5.

A half length column section is provided atop the three principal column sections. This half length column section is also made of two half shells jointed together, and has a groove 24 on its side turned toward the inside of the display. The two grooves in opposite sides of these two column sections serve for the mounting of a headpiece for presentation of the products. The two column sections are linked by an arch 3 constituted by two tubular sections assembled end to end, each of which is formed by two half shells of semi-circular section assembled together in the same manner described earlier.

At its bottom end the display is equipped with a pedestal or base insuring its stability and enhancing its aesthetic value, constituted by four identical elements 25 made of synthetic material formed by molding. Each element 25 comprises a wall 26 extending from one column 2 to the level of the second median plane of the display rack, where it is prolonged by a wall 27 extending parallel to this plane up to the point of contact with a panel 5. Each element 25 is equipped with a hasp 28 having holes or perforations 29 for the passage of assembly bolts 30 to the element situated on the other side of the display. Further, the wall 27 has holes 32 for the passage of assembly bolts 33 to the element situated on the same side of the display. Finally, the rigidity of the ensemble is increased with a rail 34 whose central part corresponds to the rail 23 and serves for the assembly of panel 5 whose external parts have grooves for the insertion of the extremities 35 of the walls 27. Each ensemble of two elements situated on a same side of the display delimit a space which is closed by a tablet 36.

Additionally, the finish of this display is further enhanced with cover strips 37 covering the linkage zone between a half shell 10 and its associated panel 5. The attachment of each cover strip is done with clips 38 bound to it and designed to be inserted in holes 39 made in the panel.

Figure 7:
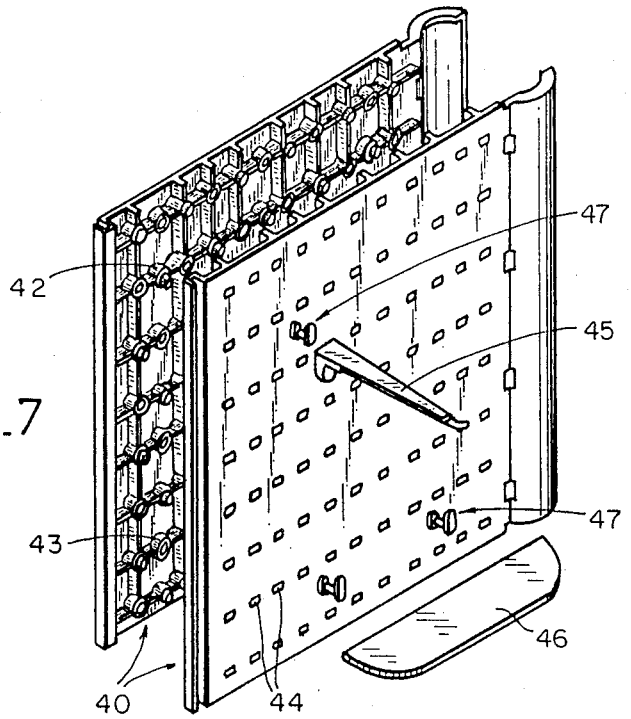
FIG. 7 is an exploded view in perspective of two panels.

FIG. 7 represents a variation in the realization of the display rack according to which two panels 40, set back to back, comprise regularly distributed male funnels 42, protruding out of each panel, and designed to be forcefully encased into other female funnels 43. The total joining of the two panels across their surface is thus accomplished.

Figure 9:
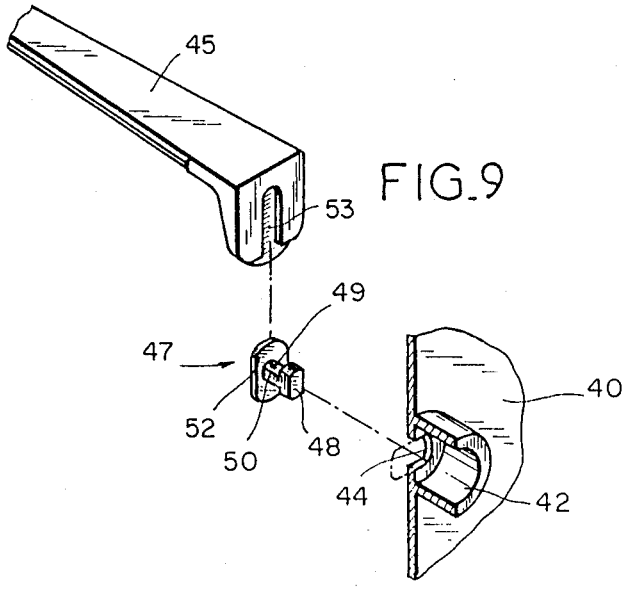
FIG. 9 is an exploded view in perspective of an item suspension hook, with its associated fixing peg, and of a fixing opening in the panel.
Figure 10:
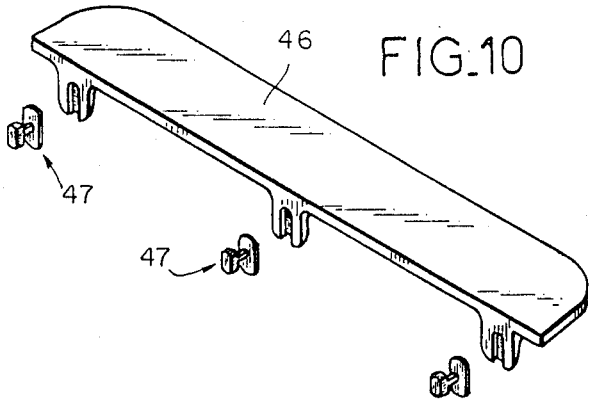
FIG. 10 is a view in perspective of a shelf, and of its fixing pegs.
Figure 8:
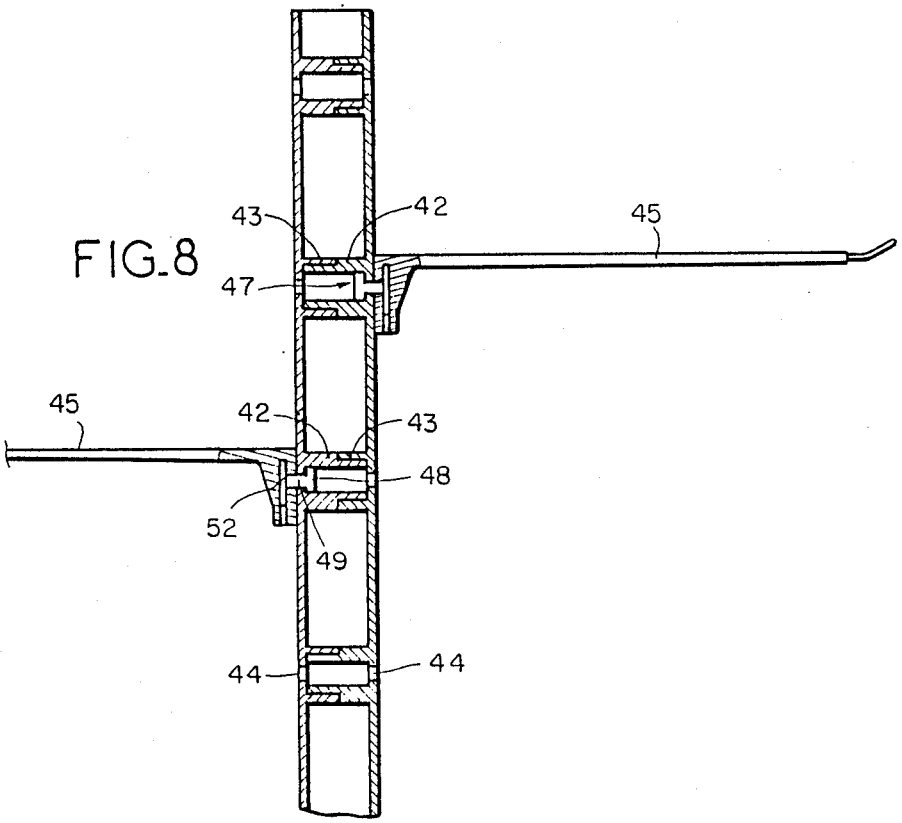
FIG. 8 is a large scale vertical cutaway view of two assembled panels, each equipped with an item suspending hook.

FIGS. 7 to 9, show the bottom of each funnel has a rectangular opening 44 in the panel 40 from which it protrudes.

The suspension hooks 45 or shelf 46 fixing pegs are constituted of a part globally referenced as 47. This part has a rectangular tip 48 having a size which corresponds to the opening in the panel, in order to allow the introduction of the peg in the panel opening. The tip 48 is integral with an intermediary or middle part 49, the length of which is equal to the panel thickness, the section of which is square, and the side length of which corresponds to the peg width. Two opposite edges 50 in this part 49 are rounded so that their spacing is equal to the size of one side of the square.

This middle part 49 is equipped on its end opposite to the tip 48 with a small plate 52, designed to be inserted in a gusset 53 on the item suspension shank or hook 45 or shelf 46.

Only one fixing peg 47 is required to attach a suspending shank or hook. Two fixing pegs 47 are necessary to attach a shelf 47, although three pegs are preferred to provide additional stability of the shelf.

When mounting a shank or hook, the fixing peg is first joined to the shank or hook, then the tip 48 is inserted in one of the rectangular openings 44. It is necessary at that time to pivot the fixing peg assembly ninety degrees, which is made possible by the rounded edges 50 on the middle part.

When mounting a shelf, the parts 47 must be affixed on the panel first, before sliding the shelf into position.

It arises from the preceding that the invention brings forth a big improvement to the existing technique by providing a display of simple conception, entirely made of synthetic material, with the possibility to dismantle it in small elements requiring little space. The display aesthetics are enhanced by the many possibilities that exist to contrast colors between columns, column section assembly parts, cover strips covering the fasteners of the half shells constitutive of the columns, and the cover strips covering junction zones between the half shells and the panels.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A display rack comprising:

two vertical tubular columns;

arch means having two ends respectively connected to an upper portion of said two columns;

a pedastal connected between bottom portions of said columns and protruding from a plane containing said columns for supporting said display rack;

a product presentation headpiece connected between upper portions of said two columns;

panels connected between parallel sections of said two columns for linking said two columns together; and hook means adapted to be affixed to said panels for supporting items to be displayed, wherein each column comprising a plurality of tubular sections longitudinally placed one on top of another, each tubular section comprising two semicircular half shells, complementary fasteners placed in opposing fashion along at least one edge of the half shells for connecting the half shells together, and at least one inwardly oriented flange located on each end of said half shells substantially perpendicularly to a longitudinal axis thereof; and said column further comprising:

a plurality of cylindrical assembly parts each having at least one circular groove for receiving said flange for enabling rotation of said tubular sections and for preventing axial movement of said tubular sections.

2. The display rack according to claim 1, wherein said fasteners for connecting the half shells comprise hooks protruding from an edge of one of the half shells and openings formed in an edge of the other half shell so as to correspond to said hooks.

3. The display rack according to claim 1, wherein said fasteners are located in a groove which also houses a glued cover strip to cover said fasteners when the display rack is assembled.

4. The display rack according to claim 1, wherein each assembly part disposed between two column sections comprises at least one orifice for mounting an attachment key, wherein one end of said attachment key is mounted in one column and another end of the key is mounted in another column for connecting two display racks together.

5. The display rack according to claim 1, wherein each half shell is molded with one of said panels, said panels having holes for receiving said hook means.

6. The display rack according to claim 5, wherein said hook means comprises shanks.

7. The display rack according to claim 5, wherein said display rack has a width approximately twice the width of one of the panels, a vertical edge of each panel opposite to the vertical edge connected to a half shell has an outward groove for facilitating the assembly of the two panels connected to the half shells situated at a determined level of the display rack, said display rack further comprising a synthetic material rail for connecting two panels for assembling the display rack.

8. The display rack according to claim 5, wherein each panel comprises a series of holes provided near the edge connected with the half shell used to clip-fasten a cover strip having clips adapted to be inserted in said holes.

9. The display rack according to claim 5, wherein said hook means comprise hooks.

10. The display rack according to claim 5, wherein said hook means comprise shelves.

11. A display rack comprising:

two vertical tubular columns;

arch means having two ends respectively connected to an upper portion of said two columns;

a pedastal connected between bottom portions of said columns and protruding from a plane containing said columns for supporting said display rack;

a product presentation headpiece connected between upper portions of said two columns;

panels connected between parallel sections of said two columns for linking said two columns together; and hook means adapted to be affixed to said panels for supporting items to be displayed, wherein two panels set back to back, comprises regularly distributed funnels protruding from each panel, one of said funnels being adapted to be forcibly encased into the other.

12. The display rack according to claim 9, wherein a bottom portion of each funnel has a rectangular opening oriented horizontally in the panel from which the funnel is protruding.

13. The display rack according to claim 10, wherein said hook means comprises a fixing peg comprising a rectangular tip having a size corresponding to the size of said rectangular opening in the panel for introducing said peg into said rectangular opening, and a middle portion extending from one end of said tip having a length substantially equal to the thickness of the panel, a square cross-section, a side length substantially corresponding to the width of said tip, and having two opposite rounded edges so that the spacing between the rounded edges is substantially equal to the spacing between the square sides, wherein said peg is mounted on an associated element such that, when affixed to said panel, the length of said tip is oriented vertically.

14. The display rack according to claim 13, wherein said peg further comprises a perpendicularly oriented plate connected to another end of said middle portion for insertion in a gusset on the associated element to which said peg is to be connected.

15. A display rack comprising:

two vertical tubular columns;

arch means having two ends respectively connected to an upper portion of said two columns;

a pedastal connected between bottom portions of said columns and protruding from a plane containing said columns for supporting said display rack;

a product presentation headpiece connected between upper portions of said two columns;

panels connected between parallel sections of said two columns for linking said two columns together; and hook means adapted to be affixed to said panels for supporting items to be displayed, wherein said pedastal comprises four substantially identical molded elements formed of a synthetic material, each element having a first wall extending from one column of the display rack to a median plane intersecting the display rack, and a second wall extending from said first wall along said median plane to one of said panels, each element further comprising a perforated hasp for receiving a bolt for connecting a corresponding element on the other side of the panel, said second wall having holes for receiving bolts between that element and the element situated on the same side of the display rack.

* * * * *